US006288694B1

(12) United States Patent
Jäger et al.

(10) Patent No.: US 6,288,694 B1
(45) Date of Patent: Sep. 11, 2001

(54) SUPPRESSION OF THE MOIRE EFFECT ON A FLAT DISPLAY SCREEN

(75) Inventors: Axel Jäger, Sussargues; Philippe Rommeveaux, Echirolles, both of (FR)

(73) Assignee: Pixtech S.A., Rousset (FR)

( * ) Notice: Subject to any disclaimer, the term of this patent is extended or adjusted under 35 U.S.C. 154(b) by 0 days.

(21) Appl. No.: 09/178,141

(22) Filed: Oct. 23, 1998

(30) Foreign Application Priority Data

Oct. 24, 1997 (FR) ..... 97 13592

(51) Int. Cl.[7] ..... G09G 3/22
(52) U.S. Cl. ..... 345/74.1; 313/169.5
(58) Field of Search ..... 345/74.1, 74.2; 313/169.5

(56) References Cited

U.S. PATENT DOCUMENTS 5,578,225 11/1996 Chien .
5,633,650 5/1997 Kishino et al. .

FOREIGN PATENT DOCUMENTS

WO9606450 2/1996 (WO) .

*Primary Examiner*—Amare Mengistu
(74) *Attorney, Agent, or Firm*—Arthur L. Plevy; Duane, Morris & Heckscher

(57) ABSTRACT

The present invention relates to a flat display screen including a light-emitting source organized in a first array of strips generally parallel in a first direction, and at least one second opaque array, interposed between the light-emitting source and a display surface, and organized in a second direction generally non-perpendicular to the first direction, at least one of the arrays exhibiting, along an axis parallel to the general direction of the first array and whatever the position of this axis in a perpendicular direction, a constant proportion of transparent surface for an elementary pattern.

10 Claims, 3 Drawing Sheets

SUPPRESSION OF THE MOIRE EFFECT ON A FLAT DISPLAY SCREEN

BACKGROUND OF THE INVENTION

1. Field of the Invention

The present invention relates to the field of flat display screens. It more specifically relates to flat screens of the type comprising a cathode with microtips for electron bombarding an anode carrying phosphor elements.

2. Discussion of the Related Art

FIG. 1 shows the functional structure of a conventional flat microtip screen in which the screen surface is formed of a glass plate supporting the cathodoluminescent anode.

Such a microtip screen is essentially formed of a cathode 1 with microtips 2 and of a grid 3 provided with holes 4 corresponding to the locations of microtips 2. Cathode 1 is placed opposite a cathodoluminescent anode 5, a glass substrate 6 of which generally forms the screen surface.

The operating principle and the detail of the structure of such a microtip screen are described, for example, in U.S. Pat. No. 4,940,916 assigned to the Commissariat a l'Energie Atomique.

Cathode 1 is organized in columns and is formed, on a substrate 10, for example made of glass, of cathode conductors organized in meshes from a conductive layer. Microtips 2 are made on a resistive layer 11 deposited on the cathode conductors and are arranged within meshes defined by the cathode conductors. FIG. 1 partially shows the inside of a mesh, without showing the cathode conductors. Cathode 1 is associated with grid 3 which is organized in lines, an isolating layer (not shown) being interposed between the cathode conductors and grid 3. The intersection of a line of grid 3 and of a column of cathode 1 defines a pixel.

This device uses the electric field created between cathode 1 and grid 3 to extract electrons from microtips 2 towards phosphor elements 7 of anode 5, crossing an empty space 12. In the case of a color screen such as shown in FIG. 1, anode 5 is provided with alternate strips of phosphor elements 7, each corresponding to a color (Red, Green, Blue). The strips are separated from one another by an insulator 8. Phosphor elements 7 are deposited on electrodes, formed of corresponding strips 9 of a transparent conductive layer such as indium and tin oxide (ITO). The sets of red, green, blue strips are alternately biased with respect to cathode 1, so that the electrons extracted from the microtips 2 of a pixel of the cathode/grid are alternately directed to the phosphor elements 7 facing each of the colors. The phosphor elements may also be organized in pads individualized by pixel and biased by sets of pads of same color by means of strips 9, so that the phosphor elements are still generally organized in strips. In the case of a monochrome screen, the anode is formed of a plane of phosphor elements of same color or of two sets of alternate strips of phosphor elements of same color.

The present invention more specifically relates to screens in which the anode is formed of several sets of strips of phosphor elements, or of pads of phosphor elements. Reference will be made hereafter to color screens. However, the present invention also applies to monochrome screens, the phosphor elements of which are organized in strips and to screens, the anode of which is formed of a plane of phosphor elements of same color.

Often, a screen meant to be watched from the anode, which will be called hereafter a "transparent anode screen", is associated with a filter, on the anode side, for example, a filter against electromagnetic radiation or a filter restricting the angle of sight. Such a filter is generally formed of an array of elongated parallel opaque patterns, or of two perpendicular arrays of elongated parallel opaque patterns.

The addition of such a filter to a transparent anode flat screen introduces a so-called "moiré" phenomenon which is prejudicial to the quality of the display. The moiré effect corresponds to a distortion (luminance and chrominance variation) of the image according to the screen region or to the angle of sight. In a transparent anode screen, the moiré phenomenon is due to the presence, between the array light-emitting surface (the anode) and the display surface (the filter surface), of one or several opaque arrays, the directions of which are not perpendicular to the anode strips.

More generally, a moiré phenomenon can be observed as soon as an opaque array having a direction which is not perpendicular to the direction of the light-emitting elements is located between the emissive array and the display surface, for example, if the opaque array has a direction parallel to the direction of the light-emitting elements but has a different pitch. Thus, even if the filter comprises a single array parallel to the anode strips, a moiré phenomenon appears if the pitch is different, which is frequent in practice, in particular for a color screen where the width of a pixel generally corresponds to three parallel strips of the anode while the pitch of the opaque patterns of the filter is independent from the screen.

In the case of a monochrome screen with a plane of phosphor elements, the moiré phenomenon appears when the displayed patterns (images) themselves form an array.

The main consequence of a moiré phenomenon is that the image seen is different in luminance (and in chrominance for color screens) according to the region observed or to the angle of sight.

The moiré phenomenon observed on transparent anode screens by the addition of a filter introducing an opaque array can also be observed in the case of flat microtip screens in which the cathode forms the display surface.

It is indeed preferred to make the screen viewable from the cathode to improve the light efficiency of the screen. In a transparent anode screen, a major part of the light emitted by the phosphor elements is emitted towards the cathode and is thus lost by absorption. In the case of a transparent cathode, a reflective layer may be deposited under the phosphor elements.

Thus, all the light emitted is transmitted to the observer on the cathode side.

FIG. 2 schematically illustrates an example of a so-called "transparent cathode" microtip screen, that is, a screen meant to be viewed from the cathode.

As previously, cathode 1 is made on a substrate 10, here a transparent glass substrate, of conductors 13 organized in columns. A resistive layer 11 is added on conductors 13 and microtips 2 are deposited on this resistive layer. Conductors 13 are, most often, meshed and, as an alternative, these conductors are deposited on resistive layer 11, a group of microtips 2 being deposited at the center of each mesh (not shown) defined by a conductor 13. For clarity, a few microtips only have been shown in FIGS. 1 and 2. It should however be noted that the microtips are several thousands per screen pixel.

Grid 3, formed of a conductive layer organized in rows perpendicular to the cathode columns, is deposited on an insulating layer 14 added on cathode 1, grid 3 being provided with holes 4 at the locations of the microtips.

Anode 5 is formed on a substrate 6, for example, made of glass, and is formed of phosphor elements 7 deposited on a biasing conductive layer 9 organized in strips parallel to columns 13. Referring to a screen viewable from the cathode, a reflective layer (not shown) is interposed between phosphor elements 7 and layer 9 or between substrate 6 and layer 9, to reflect the light to the cathode. This reflective function may be ensured by conductive layer 9 itself.

A problem which arises with a transparent cathode screen is that the conductive tracks of grid 3 and of cathode 1 are likely to create obstacles to the travel of light 1 to eye O of the user, even placed in front of the region viewed.

To partially solve this problem, document FR-A2,682,211 describes a solution which consists of organizing the anode in the form of parallel strips of phosphor elements parallel to the grid rows, and to provide a cathode which has no microtips above the strips of phosphor elements, the conductive grid layer also being open above the strips. The cathode conductors are not meshed but are here made in a transparent conductive layer, and only this conductive layer is present on the travel of the light above the strips of phosphor elements of the anode.

A disadvantage of this solution is that it does not suppress the occurrence of shaded areas according to the angle of sight of the observer. Indeed, the grid rows always form an obstacle to the travel of the light, since the observer cannot be strictly in front of each region viewed. Further, this solution does not enable to provide a resistive layer of homogenization of the electron emission on the cathode side. Further, the grid rows, parallel to the anode rows, introduce a moiré effect.

Another solution to improve the transparency of the cathode consists of etching the resistive layer, the grid and the cathode conductors so that they have a maximum opening above the strips of phosphor elements to minimize the opaque surface on the cathode side. Although such a solution improves the brightness of the screen, it does not suppress the occurrence of the moiré phenomenon due to the cathode/grid structure, which implies an array parallel to the strips of phosphor elements.

Thus, another problem which is raised in a transparent cathode screen is that an opaque array which is not perpendicular to the light-emitting strips necessarily is present between these strips and the display surface (substrate 10). Accordingly, a moiré effect appears, even in the absence of a filter.

U.S. Pat. No. 5,578,225 provides, to solve this problem, a cathode and a grid which are entirely transparent, except for the microtips. The suppression of any opaque array effectively enables suppressing the appearance of the moiré phenomenon since any local transparency variation is suppressed. However, this solution is, in practice, unsuited. Indeed, such a solution does not enable providing a resistive layer for equalizing the electron emission. In particular, the ITO currently used as a transparent conductive material is not sufficiently resistive to make such a layer. ITO has a resistance per square of about 20 ohms, while the resistive layer of a conventional screen generally is formed in a material having a resistance per square of about 1 MΩ. The use of ITO for the resistive layer would result in considerably increasing the distance of access to the tips by this resistive layer.

Another disadvantage of this solution is that the making of ITO cathode conductors results in a luminance degradation from one end of the cathode columns to the other due to the resistance of ITO. Indeed, although ITO is of relatively low resistivity, this resistivity is sufficient to cause a non-negligible voltage drop across each column, the columns generally being brought to a voltage comprised between 0 and 30 volts according to the brightness desired for the pixel involved. This voltage drop is not disturbing, on the anode side, due to the high biasing voltage of the anode strips (several hundred volts).

To avoid this voltage drop across the cathode columns and the grid rows, U.S. Pat. No. 5,578,225 provides an opaque lateral conductor of low resistivity along each cathode conductor and along each grid conductor. However, this solution reintroduces two perpendicular opaque arrays which then result in a new moiré phenomenon.

The problems associated with the moiré phenomenon described hereabove in relation with the gate and cathode arrays may also, in a transparent cathode screen, originate from filters as in a screen observable from the anode, or from additional grids constitutive of a double- or triple-grid screen.

SUMMARY OF THE INVENTION

The present invention aims at overcoming the disadvantages of the above conventional screens.

An object of the present invention is to provide a novel solution to avoid the occurrence of a moiré phenomenon on a screen, the anode of which is generally organized in strips, either in a screen, the anode surface of which is formed by the anode and which is equipped with a filter, or in a transparent cathode screen.

Another object of the present invention is to provide a transparent cathode screen which suppresses the risks of occurrence of the moiré phenomenon without adversely affecting the homogenization of the electron emission of the cathode microtips. The present invention aims, in particular, at preserving the use of a resistive layer on the cathode side.

The present invention originates from a new approach of the inventors to solve the moiré problem. According to this approach, it is not attempted to avoid local transparency variations within a same pixel as in documents U.S. Pat. No. 5,578,225 and FR-A-2,682,211, but it is provided that these local transparency variations are not visible by the observer, whatever the angle of sight.

The approach provided by the present invention consists of providing that the transparency of an elementary pattern of an opaque array, generally aligned with a light-emitting array and crossed by the light beams, is, in the direction of this alignment, regular over the entire pattern. An "elementary pattern" designates, in the present invention, a pattern of a size corresponding to the visual perception threshold of the observer. Generally, the elementary pattern will thus be formed by a pixel. However, it could also be a group of several pixels.

More specifically, the present invention provides a flat display screen including a light-emitting source organized in a first array of strips generally parallel in a first direction, and at least one second opaque array, interposed between the light-emitting source and a display surface, and organized in a second direction generally non-perpendicular to the first direction, at least one of the arrays exhibiting, along an axis parallel to the general direction of the first array and whatever the position of this axis in a perpendicular direction, a constant proportion of transparent surface for an elementary pattern.

According to an embodiment of the present invention, the flat screen includes a cathodoluminescent anode organized in strips of phosphor elements, and a cathode with electron emission microtips, generally organized in parallel columns and associated with a grid generally organized in rows perpendicular to the cathode columns, the cathode or grid forming the second opaque array.

According to an embodiment of the present invention, the grid, or respectively, the cathode, forms a third opaque array, of generally parallel lines, organized in a direction perpendicular to the direction of the second array.

According to an embodiment of the present invention, each line of the cathode or, respectively, of the grid, constitutive of the second array, includes a succession of staggered active rectilinear portions, connected by oblique sections.

According to an embodiment of the present invention, each line of the third array includes a section rectilinear in its general direction, connecting active portions likely to cooperate with the active portions of the second array.

According to an embodiment of the present invention, the grid rows are generally parallel to the anode strips.

According to an embodiment of the present invention, the cathode columns are generally parallel to the anode strips.

According to an embodiment of the present invention, each cathode column is provided with active portions above every other grid row.

According to an embodiment of the present invention, the first light-emitting array includes strips in zigzag, the dimensions of an elementary pattern corresponding, at least in a first direction, to an integer multiple greater than or equal to 1 of the distance separating ends of arrowheads defined by the strips of the first array.

According to an embodiment of the present invention, the anode is formed of at least two sets of alternate strips, and the convex, respectively concave, ends of the arrowheads formed by the strips of a set are aligned, in the general direction of the strips, with the concave, respectively convex, ends of the arrowheads of a neighboring strip belonging to the same set.

The foregoing objects, features and advantages of the present invention will be discussed in detail in the following non-limiting description of specific embodiments, in conjunction with the accompanying drawings.

DETAILED DESCRIPTION

Figure 1:
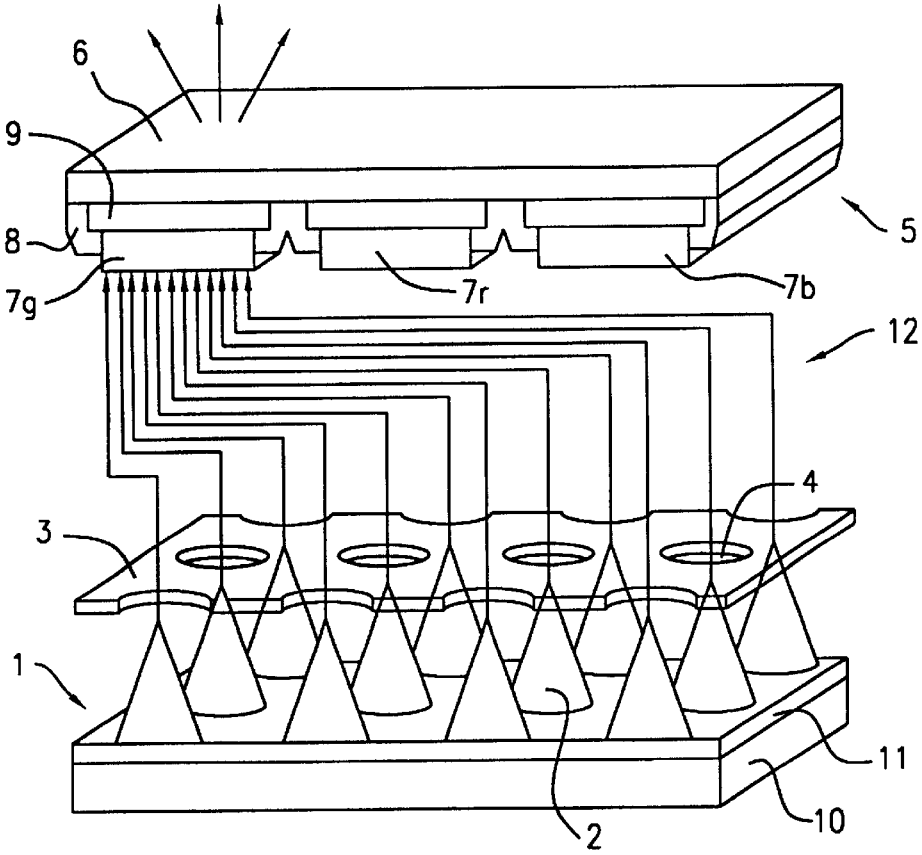
(PRIOR ART) FIG. 1
FIGS. 1 and 2, previously described, are meant to show the state of the art and the problem to solve.

For clarity, the representations of the drawings are not to scale and only those elements necessary to the understanding of the present invention have been shown in the drawings. The same elements are designated in the different drawings with the same references.

Figure 3:
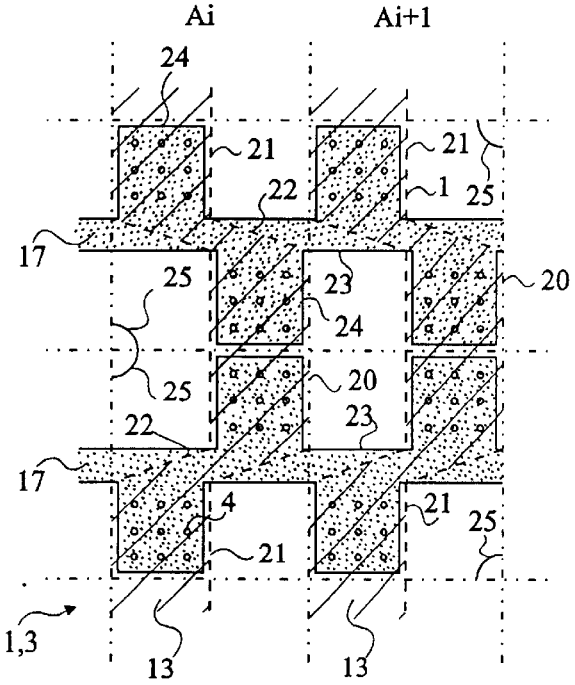
FIG. 3 partially shows a first embodiment of a transparent cathode according to the present invention.

FIG. 3 shows a first embodiment of a transparent cathode according to the present invention. This embodiment is meant for a flat screen in which the strips of phosphor elements of the anode (symbolized by columns $A_i$, $A_{i+1}$) are parallel to the general direction of the cathode conductors. FIG. 3 is a partial top view of cathode 1 associated with grid 3.

Cathode 1 is generally organized in columns and is formed, on a glass substrate, of conductors 13, the microtips (not shown) being made on a resistive layer, the pattern of which is identical to that of the cathode columns. Preferably, conductors 13 are organized in meshes from a conductive layer and the microtips are arranged inside meshes defined by these cathode conductors. In FIG. 3, the meshing of the cathode conductors has not been shown for clarity and the meshes defining a column will be referred to hereafter altogether as conductor 13.

Cathode 1 is associated with grid 3 which is generally organized in conductive layers 17 perpendicular to the cathode columns. An insulating layer (not shown) is conventionally interposed between the cathode conductors and the grid rows. The conductive layer, in which are defined rows 17, and the insulating layer comprise holes 4 above each microtip of the cathode.

According to the present invention, the conductive materials used to form cathode conductors 13 and grid rows 17 are opaque materials. Similarly, the same opaque material as that used in a transparent anode screen (FIG. 1) is used to make the resistive layer.

According to the present invention, the pattern of conductors 13 is not rectilinear, while remaining generally parallel to strips $A_i$, $A_{i+1}$ of the anode.

Preferably, each cathode conductor includes rectilinear active portions 20, 21, staggered in the general direction of the column. Portions 20, 21 are interconnected by sections 22 of oblique direction which are, for example and according to this embodiment, contained within the width of rectilinear portions 23 constitutive of rows 17. Each row 17 comprises a rectilinear section 23 perpendicular to the general direction of cathode conductors 13 and includes, on either side of its section 23, perpendicular active portions 24, of a size substantially corresponding to half a portion 20, 21, of a cathode conductor 13. A given row thus includes two staggered portions 24 above each cathode conductor that it crosses. Preferably, the microtips are formed at the level of portions 20 and 21.

In the embodiment shown in FIG. 3, a pixel 25 includes half a portion 20 and half a portion 21 of cathode conductor, shifted with respect to each other in the general alignment of conductor 13. These two half-portions are associated with a same grid row 17. Thus, in FIG. 3, four pixels 25 are shown.

The embodiment of FIG. 3 relating to a transparent cathode, the substrate areas outside grid rows 17 and cathode conductors 13 are transparent, either because all areas constitutive of the cathode and of the grid have been shown in these locations, either due to the presence of the insulating layer (which is then transparent) separating the cathode grid.

Conversely, the opaque areas are formed either by the presence of a section 23 of a grid row, either by the presence of a portion 20, 21, of a cathode conductor.

An elementary pattern according to the present invention is here formed of a pixel 25. Because of the patterns of the cathode conductors and of the grid rows, the transparency of a pixel is constant all across the pixel in the direction of rows 17, that is, each pixel includes, along an axis parallel to the general alignment of cathode conductors 13, a same proportion of opaque surface, whatever the position of this axis in the perpendicular direction (that is, in the direction of rows 17).

The fact that grid 3 includes rectilinear sections 23 is not disturbing concerning the moiré effect, since these sections 23 are perpendicular to the anode strips.

Accordingly, whatever the position of the observer with respect to the cathode surface, no moiré phenomenon is visible by said observer. Further, even if each pixel includes rectilinear opaque surfaces which are not perpendicular to the anode strips, these surfaces are at a scale which cannot be seen by the observer.

It should be noted that that the pitch of the anode strips is of no importance. Thus, each strip $A_i$, $A_{i+1}$ of the anode cannot be formed of three parallel strips of phosphor elements of different colors in the case of a color screen, or of two spaced apart parallel strips of phosphor elements of same color in the case of a monochrome screen. A pixel 25 such as shown in FIG. 3 may actually correspond to a sub-pixel of a given color, a screen pixel being then defined by three sub-pixels each corresponding to one color (red, green, blue).

In FIG. 3, as well as in all the following drawings, the opaque areas of the grid conductors have been schematized by points and the opaque areas of the cathode conductors (or of the resistive layer) are schematized by hatchings. The pixel limits have been symbolized by mixed lines.

Figure 4:
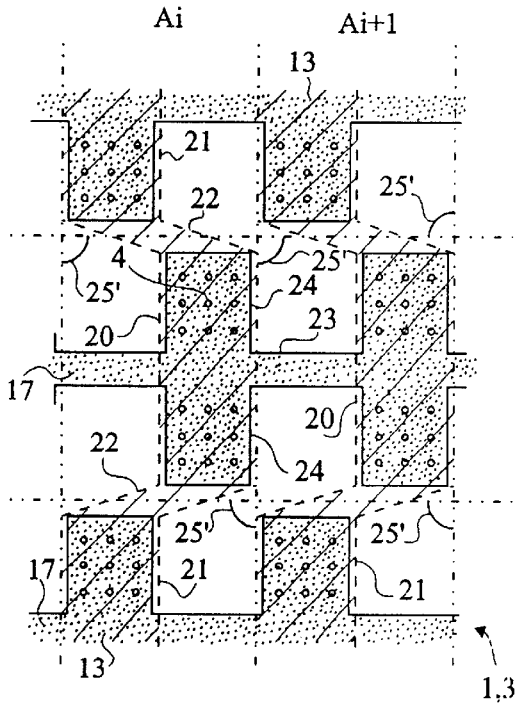
FIG. 4 partially shows a second embodiment of a transparent cathode according to the present invention.

FIG. 4 shows an embodiment of a transparent cathode according to the present invention. As in the first embodiment, cathode conductor columns 13 are generally parallel to the strips of phosphor elements of the anode. Similarly, each cathode column 13 includes a succession of staggered active rectilinear portions 20, 21, connected by oblique sections 22. Further, the grid is organized in rows 17 and each row includes a rectilinear section 23, perpendicular to the anode strips, to connect active portions 24 above cathode portions 20, 21.

According to the embodiment illustrated by FIG. 4, each grid row 17 is associated with entire rectilinear portions 20 (or 21) of cathode conductors 13. A given row 17 includes active portions 24 above portions 20 (or 21) of the conductors 13 crossed thereby, portions 24 of a same row 17 being thus aligned two by two perpendicularly to section 23. Thus, a distinction between the embodiment illustrated by FIG. 4 and that of FIG. 3 is that the sections 22 of connection of cathode conductors 13 are not located above rectilinear portions 23 of grid rows 17.

In the embodiment shown in FIG. 4, a pixel 25', defined by the intersection of a grid row 17 with a cathode conductor 13 includes two aligned portions 20 (or 21). According to this embodiment, an elementary pattern of the present invention is formed of two successive pixels 25' of a same cathode conductor 13. In this elementary pattern, the ratio between the transparent surface area and the opaque surface area along an axis parallel to the general direction of the cathode conductors is constant whatever the position of this axis in the direction of grid rows 17.

It should be noted that, in the embodiment illustrated in FIG. 3, the smallest pattern respecting the regularity of the transparency ratio according to the present invention is the pixel, but that this regularity is respected for patterns of a size of several pixels and whatever this size. Similarly, in the embodiment illustrated in FIG. 4, the smallest pattern respecting the regularity of the transparency ratio according to the present invention is a group of two pixels in the direction of the cathode columns, but this regularity is respected for any area comprising a multiple of this elementary pattern.

Figure 5:
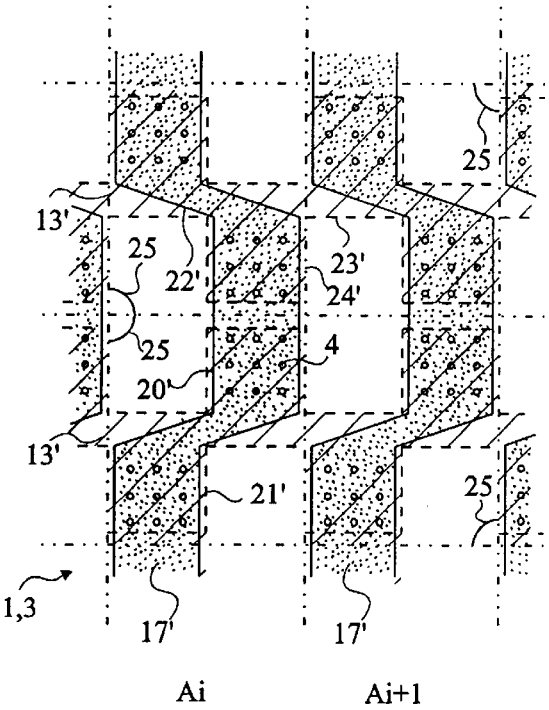
FIG. 5 partially shows a third embodiment of a transparent cathode according to the present invention.
Figure 6:
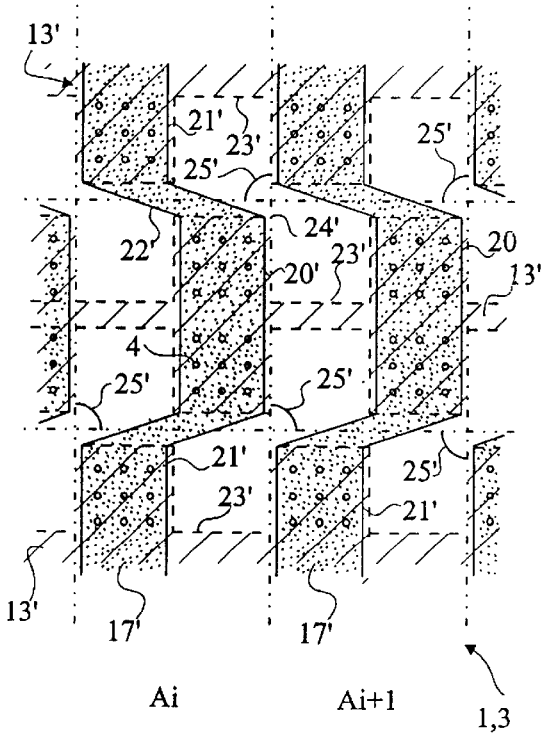
FIG. 6 partially shows a fourth embodiment of a transparent cathode according to the present invention.

FIGS. 5 and 6 show, respectively, a third and a fourth embodiment of a transparent cathode according to the present invention. According to these embodiments, rows 17' of grid 3 are now those having a general direction parallel to anode strips $A_i$, $A_{i+1}$. Thus, the pattern of a succession of staggered rectilinear active areas 20', 21' is applied to grid rows 17' and the pattern comprising rectilinear connection sections 23' and perpendicular active portions 24' is applied to cathode conductors 13'.

FIG. 5 shows an embodiment in which, as in FIG. 3, an elementary pattern is formed of a screen pixel 25. FIG. 6 shows an embodiment in which, as in FIG. 4, an elementary pattern is formed of two successive pixels 25' in the alignment of anode strips $A_i$, $A_{i+1}$.

It should be noted that, in any of the embodiments illustrated by FIGS. 3 to 6, it is also possible to organize the array (grid or cathode) perpendicular to the anode strips with a pattern having no rectilinear connection section, that is, with a pattern substantially having the same general shape as the other array (cathode or grid) parallel to the anode strips.

Figure 7:
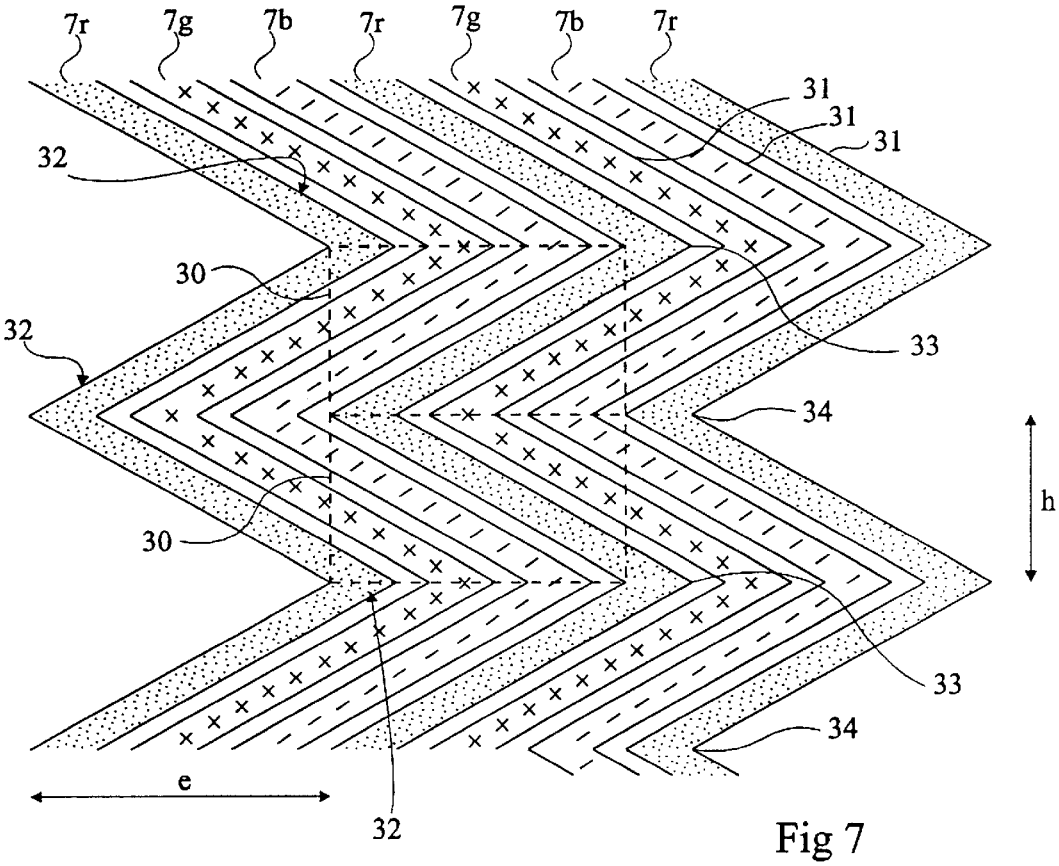
FIG. 7 partially shows an embodiment of an anode according to the present invention.

FIG. 7 shows an embodiment of an anode 5 according to the present invention. This embodiment is more specifically meant for a transparent anode screen to avoid any superposition of aligned patterns with a filter added on the anode.

In the case of a transparent anode, it is assumed that the cathode/grid is made conventionally, that is, it includes two perpendicular arrays respectively defining the cathode columns and the grid rows (FIG. 1).

According to the present invention, the strips of phosphor elements 7*r*, 7*g*, 7*b* are organized in zigzag while generally being in a direction parallel to the grid rows (not shown) or to the cathode columns (not shown). The zigzag shape given to strips 7*r*, 7*g*, 7*b* is such that a screen pixel 30, defined by the intersection of a cathode column with a grid row, preferably includes a same surface proportion of phosphor elements of each of the colors. Neighboring rectilinear portions 31 of strips 7*r*, 7*g*, 7*b* in the direction (horizontal in FIG. 7) perpendicular to the direction of the general alignment (a vertical alignment in FIG. 7) of the strips, are parallel. Each strip 7*r*, 7*g*, 7*b* defines successive alternate arrowheads 32 in the vertical direction (general direction of the strips), each formed of two joined portions 31, a same portion 31 belonging to two contiguous arrowheads 32.

An elementary pattern (pixel), defined by the cathode/grid, is above a rectangular surface 30, a first dimension of which is an integer multiple higher than or equal to 1 of the interval h between ends 33, 34, of two successive arrowheads in the vertical direction, or of the interval e between the ends 33 (or 34) of the arrowheads of two strips of same color in the horizontal direction. The second dimension of the rectangular surface is, preferably, such that the proportion between the colors is respected.

According to a preferred embodiment, the inclination of rectilinear portions 31 with respect to the direction of the general alignment of the strips, and the width and pitch of these portions are such that the, for example convex (external), ends 33 of arrowheads 32 of a color are vertically aligned (general strip direction) with the, for example, concave (internal), ends 34 of the arrowheads of the following or preceding strip of same color. An advantage of such an embodiment is that the second dimension of the elementary strip can then be of any given value, whatever the direction (vertical or horizontal) of the first dimension fulfilling the previously-discussed condition, the color proportion always being respected.

In a transparent anode screen, assuming that a filter is associated with the anode, this filter may be formed, either of an array of lines parallel to the general direction of the anode strips, or of two perpendicular arrays creating lines parallel and perpendicular to the general anode strip alignment. In both cases, no rectilinear portion of strip of phosphor elements is parallel to a direction of the filter. Further, according to the present invention, the shape given to the anode strips results in that, whatever the position of an axis parallel to the general alignment of the anode strips, perpendicularly to this general direction, the proportion of phosphor elements along this axis is constant.

Thus, whatever the position of the observer, especially whatever the angle of sight, no moiré effect appears by the superposition of an array formed by the added filter.

Figure 2:
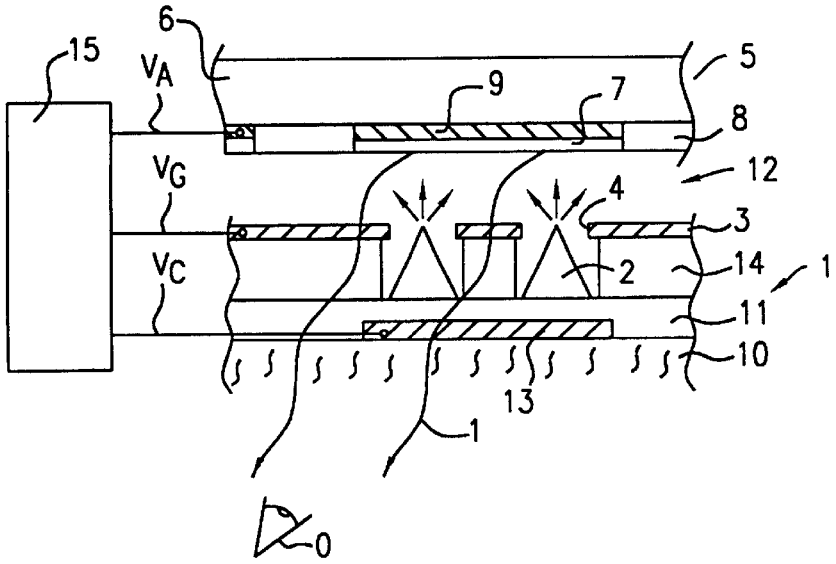
(PRIOR ART) FIG. 2

The embodiment illustrated by FIG. 7 also applies to the case of a transparent cathode. Indeed, with such an anode shape, it is possible to use a conventional transparent cathode (FIG. 2) in which the cathode columns and the grid rows form two perpendicular arrays of opaque lines.

An advantage of the present invention is that is guarantees a regular transparency of each elementary pattern (pixel or pixel group) over the entire screen surface.

Another advantage of the present invention is that, within an elementary pattern, this transparency is regular from on end to the other of the elementary pattern in a direction perpendicular to the general alignment of the light-emitting source. Thus, any occurrence of the moiré phenomenon is suppressed.

Another advantage of the present invention is that it keeps an opaque structure for the making of the grid rows and, in particular, of the cathode columns. Thus, the present invention associates the cathode conductors with a resistive layer of homogenization of the electron emission by the microtips.

Figure 8:
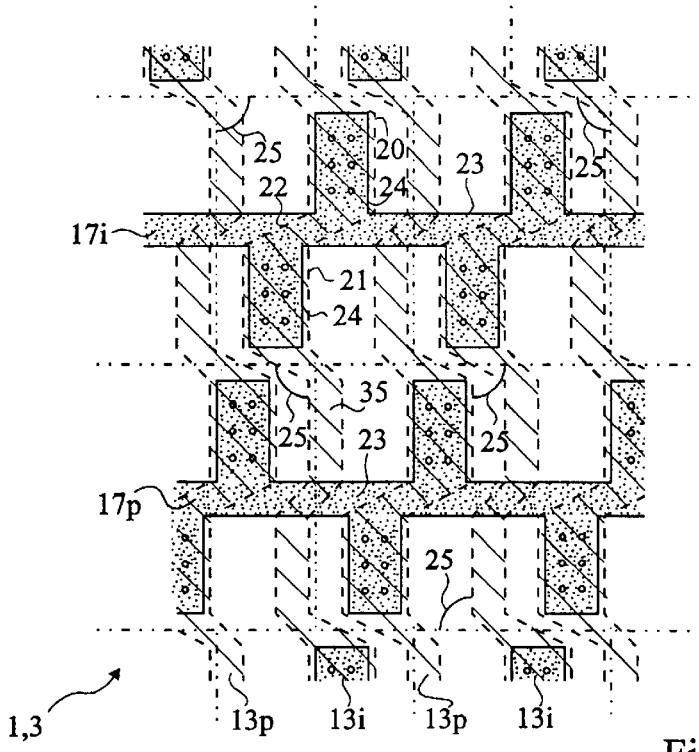
FIG. 8 partially shows a fifth embodiment of a transparent cathode according to the present invention, applied to a double grid row scanning.

FIG. 8 illustrates a fifth embodiment of a transparent cathode according to the present invention. This embodiment is more specifically meant for a screen in which the scanning of the grid rows is performed by group of two neighboring rows. Such a display mode generally is called a "double scan". In a screen of this type, the cathode columns are divided into two parallel sub-columns $\mathbf{13}_i$, $\mathbf{13}_p$. It can be considered that, for each column, a first sub-column $\mathbf{13}_i$ addresses pixels of odd order controlled by rows $\mathbf{17}_i$ of odd order and a second sub-column $\mathbf{13}_p$ addresses pixels of even order controlled by a row $\mathbf{17}_p$ of even order. Here, the cathode columns have a general direction parallel to the general direction of the anode strips (not shown). The strips of phosphor elements are, preferably, rectilinear.

The shape given to grid rows $\mathbf{17}_i$ and $\mathbf{17}_p$ is close to that given to rows 17 of FIG. 3. However, the groups of two active portions 24 on either side of rectilinear section 23 are spaced apart in the direction of sections 23 with a sufficient interval to enable the passing of a connection section 35 of a cathode conductor $\mathbf{13}_i$, $\mathbf{13}_p$ associated with the grid row of opposite rank.

Each cathode sub-column $\mathbf{13}_i$, $\mathbf{13}_p$ successively includes groups of two rectilinear active portions 20, 21 in the column direction which are, as in the embodiment of FIG. 3, staggered with respect to each other. Portions 20 and 21 of a same group comprise microtips and are interconnected by an oblique section 22. Each group of two staggered portions 20, 21 of a sub-column $\mathbf{13}_i$, $\mathbf{13}_p$ is connected to the following group of portions 20, 21 by a section 35 formed of two rectilinear portions, also staggered, but having no microtips.

In the embodiment illustrated by FIG. 8, a screen pixel 25 contains a group of two associated portions 20 and 21. An elementary pattern corresponds, in this embodiment, to a screen pixel 25. It should be noted that a pixel may correspond to more than two sub-columns.

In a double-scan screen, the display is performed by simultaneously addressing two neighboring grid rows and by applying, to each cathode sub-column, a voltage setting the brightness reference of the pixel defined by the intersection of the active portions ot this sub-column with the corresponding grid row. Such a display mode is generally chosen when it is desired to increase the lighting duration of each pixel. Indeed, this duration may, here, be double that of a conventional screen.

It should be noted that, if desired, since the grid rows are meant to be addressed two by two, they can be interconnected two by two.

Of course, the present invention is likely to have various alterations, modifications, and improvements which will readily occur to those skilled in the art. In particular, the non-rectilinear shapes given to the cathode columns or to the grid rows, or to the anode strips, may be modified provided that they respect, for an elementary pattern, a same ratio between the opaque surface area and the transparent surface area in the general direction of this electrode. Further, the embodiments described in relation with a color screen transpose to a monochrome screen, the anode of which is formed of a plane of phosphor elements (except for the embodiment illustrated by FIG. 7), or of two alternate sets of strips of phosphor elements of same color.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A flat display screen including:

a light-emitting source organized in a first array of strips generally parallel in a first direction; and at least one second opaque array, interposed between the light-emitting source and a display surface, and organized in a second direction generally non-perpendicular to the first direction, wherein at least one of the arrays exhibits for each elementary pattern of the screen a constant transparency ratio along an axis parallel to the first direction of the first array and in a direction perpendicular to said axis.

2. The flat screen of claim 1, including a cathodoluminescent anode organized in strips of phosphor elements, and a cathode with electron emission microtips, generally organized in parallel columns and associated with a grid generally organized in rows perpendicular to the cathode columns, the cathode or grid forming the second opaque array.

3. The flat screen of claim 2, wherein the grid, or respectively, the cathode, forms a third opaque array of generally parallel lines, organized in a direction perpendicular to the direction of the second array.

4. The flat screen of claim 3, wherein each line of the cathode or, respectively, of the grid, constitutive of the second array, includes a succession of staggered active rectilinear portions, connected by oblique sections.

5. The flat screen of claim 4, wherein each line of the third array includes a section portions likely to cooperate with the active portions of the second array.

6. The flat screen of claim 5, wherein the grid rows (17') are generally parallel to the anode strips.

7. The flat screen of claim 5, wherein the cathode columns are generally parallel to the anode strips.

8. The flat screen of claim 7, wherein each cathode column ($\mathbf{13}_i$, $\mathbf{13}_p$) is provided with active portions (20, 21) above every other grid row ($\mathbf{17}_i$, $\mathbf{17}_p$).

9. The flat screen of claim 1, wherein the first light-emitting array includes strips (7*r*, 7*g*, 7*b*) in zigzag, the dimensions of an elementary pattern (30) corresponding, at least in a first direction, to an integer multiple greater than or equal to 1 of the distance (e, h) separating ends (33, 34) of arrowheads (32) defined by the strips of the first array.

10. The flat screen of claim 9, wherein the anode is formed of at least two sets of alternate strips, wherein the convex (33), respectively concave (34), ends of the arrowheads (32) formed by the strips of a set are aligned, in the general direction of the strips, with the concave (34), respectively convex (33), ends of the arrowheads of a neighboring strip belonging to the same set.

* * * * *